US008025267B2

(12) United States Patent
Sladojevic et al.

(10) Patent No.: US 8,025,267 B2
(45) Date of Patent: Sep. 27, 2011

(54) CONCRETE SIDEFORM SYSTEM

(75) Inventors: Robert Sladojevic, Blackwood (AU); Steven Girotto, Blackwood (AU); Craig Deleon, Blackwood (AU)

(73) Assignee: SRB Construction Technologies Pty. Ltd., South Australia (AU)

( * ) Notice: Subject to any disclaimer, the term of this patent is extended or adjusted under 35 U.S.C. 154(b) by 836 days.

(21) Appl. No.: 11/569,560

(22) PCT Filed: May 24, 2005

(86) PCT No.: PCT/AU2005/000738

§ 371 (c)(1),
(2), (4) Date: Jul. 3, 2007

(87) PCT Pub. No.: WO2005/116365

PCT Pub. Date: Dec. 8, 2005

(65) Prior Publication Data

US 2008/0265127 A1 Oct. 30, 2008

(30) Foreign Application Priority Data

May 24, 2004 (AU) ..... 2004902767

(51) Int. Cl.
*E04G 9/00* (2006.01)
*B22D 19/00* (2006.01)
*B28B 7/00* (2006.01)

(52) U.S. Cl. ..... 249/139; 249/93; 249/135; 249/163; 249/189; 249/205; 52/127.3; 52/127.6

(58) Field of Classification Search ..... 249/139, 249/187.1, 189, 205, 93, 120, 134, 135, 163, 249/193; 52/127.2, 127.3, 127.6; 29/428
See application file for complete search history.

(56) References Cited

U.S. PATENT DOCUMENTS

| | | | | |
|---|---|---|---|---|
| 2,705,820 | A * | 4/1955 | Torrence | 52/782.2 |
| 3,667,177 | A * | 6/1972 | Biela | 52/278 |
| 4,025,021 | A | 5/1977 | Stout | |
| 4,042,205 | A * | 8/1977 | Herrell | 249/189 |
| 4,067,155 | A * | 1/1978 | Ruff et al. | 52/105 |
| 4,183,497 | A | 1/1980 | Tamez | |
| 4,557,091 | A * | 12/1985 | Auer | 52/282.3 |

(Continued)

FOREIGN PATENT DOCUMENTS

FR 2637933 A 4/1990

(Continued)

*Primary Examiner* — Joseph Del Sole
*Assistant Examiner* — Dimple Bodawala
(74) *Attorney, Agent, or Firm* — Sughrue Mion, PLLC

(57) ABSTRACT

This invention concerns a concrete side form system suitable for factory casting or site casting concrete. The side form (10) comprises a substantially rigid longitudinally extending wall. The wall has a first face to define the edge profile of a concrete panel poured onto a casting bed (16) bounded by the wall and a second face opposite the first face having formation to enable the wall to be secured to the casting bed. The wall comprises a longitudinally extending frame having formation along at least one of its edges to removably receive a removable longitudinal insert (13) to provide a shape along an edge of the concrete panel. The removable inserts (12, 13) provide the system with the ability to simply, easily and cost effectively change the edge profile of concrete poured against the side form. Architects can use the invention to specify standard or non standard edge profiles and achieve a much more diverse range of aesthetic finishes to the concrete edges without the cost being prohibitive.

17 Claims, 16 Drawing Sheets

U.S. PATENT DOCUMENTS

| | | | | |
|---|---|---|---|---|
| 5,015,117 | A * | 5/1991 | Pawlicki | 403/300 |
| D356,645 | S * | 3/1995 | Boer | D25/119 |
| 5,918,427 | A * | 7/1999 | VanderWerf | 52/100 |
| 6,276,657 | B1 * | 8/2001 | Vappula | 249/163 |
| 6,314,691 | B1 * | 11/2001 | Takagi et al. | 52/220.1 |
| 6,322,045 | B1 * | 11/2001 | Andros | 249/188 |
| 6,547,209 | B1 * | 4/2003 | Vappula | 249/139 |
| 6,860,462 | B2 * | 3/2005 | Vappula | 249/139 |
| 6,883,772 | B2 * | 4/2005 | Takagi et al. | 249/139 |
| 7,021,601 | B2 * | 4/2006 | Vappula | 249/139 |
| 7,047,700 | B2 * | 5/2006 | Dodson et al. | 52/381 |
| 7,284,353 | B2 * | 10/2007 | Bealko | 52/656.5 |
| 2002/0059758 | A1 * | 5/2002 | Dodson et al. | 52/204.1 |
| 2002/0153469 | A1 * | 10/2002 | Eyring et al. | 249/139 |
| 2003/0084632 | A1 * | 5/2003 | Takagi et al. | 52/381 |
| 2003/0115816 | A1 * | 6/2003 | Dodson et al. | 52/381 |
| 2003/0141624 | A1 * | 7/2003 | Takagi et al. | 264/154 |
| 2005/0061948 | A1 * | 3/2005 | Brennan | 249/167 |
| 2006/0273235 | A1 * | 12/2006 | Sandqvist et al. | 249/134 |
| 2009/0295055 | A1 * | 12/2009 | Sladojevic et al. | 269/86 |

FOREIGN PATENT DOCUMENTS

| | | | |
|---|---|---|---|
| JP | 2003-184303 | A | 7/2003 |

* cited by examiner

CONCRETE SIDEFORM SYSTEM

This application claims priority from PCT Application No. PCT/AU2005/000738 filed May 24, 2005, and from Australian Patent Application No. 2004-902767 filed May 24, 2004, which applications are incorporated herein by reference.

TECHNICAL FIELD

This invention concerns a concrete sideform system. The system is suitable for factory casting ('precasting') or site casting ('tilt-up') concrete.

BACKGROUND ART

Factory casting, or precasting, of concrete panels usually takes place on a large steel platform (casting bed) in a precast yard. The sizes and shapes of the panels are determined by sideforms that are arranged on the platform, and concrete is poured into the space defined by the sideforms. When the concrete is dry the panels are transported for installation.

Alternatively, concrete panels may be poured on-site, or tilt-up. In this case the panels are cast either on concrete slabs or on transportable steel beds. Again sideforms are used to define the size and shape. The panels are subsequently lifted into position using a crane. Due to space constraints, site casting frequently involves pouring several panels one on top of another. After the lowermost panel is dry it is coated with a release agent, and the sideforms are moved up to define a new panel of the same size or smaller before a second pour. The crane lifts the panels one at a time from the stack and moves them into position.

Standard sideforms are available in the range of standard concrete panel thicknesses 125 mm, 150 mm, 175 mm, 180 mm and 200 mm.

It is virtually impossible to produce a crisp sharp edge on cast concrete, since concrete is made up of granular particles and the sharpness of the corner is governed by the size of the particles. A sharp edge would also highlight formwork that is not perfectly straight and true, and also such an edge would chip very easily. As a result all standard sideforms are shaped to place a 45° chamfer on the concrete edge so as to hide the error in trueness and also prevent damage to the concrete edge.

Folded steel plate sideforms are generally used for precasting, but not for tilt-up as they are too heavy. These sideforms are made from a steel plate that has 45° plays pressed into the top and bottom edges to form the chamfer. The plate is then welded to a steel angle, channel or square hollow section to give it strength and stability.

Aluminium sideforms are also used for both pre-cast and tilt-up applications. There are several types with locking channels at the top and bottom edges, or a keyhole or 'V-Lock' locking strip in the rear. Some of these have different angles of splay, but they are generally bulky and expensive to extrude.

When a non-standard angle is required, the only option, currently, is to use fillets cut from plywood or polystyrene foam. This is wasteful, slow, extremely labour intensive and does not produce a nice accurate finish.

Sideforms are secured to the casting bed by screw-fixing. In this case the screw holes require repair after every cast. An alternative is to bolt the sideform to the casting bed, or to a securing member, which is generally either an angle or magnet. The bolting is time consuming and the resulting structure is very heavy and difficult to manoeuvre. An alternative is to lock the securing member to the sideform using a square or 'V'-groove channel in the rear of the sideform. This technique is prone to problems when excess concrete falls into the channels and sets there.

No casting bed or surface is perfectly true and flat, whether it is made from steel, concrete or any other material. Neither are the sideforms. Gaps between the bed and the sideforms result in bleeding of water and fine particles. The result is weak and crumbly patches in the panel that have to be repaired. The most common method of preventing concrete bleeding is to place a bead of silicone between the underside of the sideform and the casting bed. Although this is effective in sealing leaks, it gives rise to substantial costs in time and labour to scrape and grind the cured silicone residue from the casting beds and sideforms before they can be used again. It also causes wear and tear and damage to both surfaces.

After the concrete is poured an aluminium screed trowel is brought down onto the concrete surface at the correct height and moved back and forth to cut the surface down to the correct height. When the trowel initially cuts the concrete surface to the right level there is concrete residue left on the trowel. Some of this falls off the trowel onto the casting bed or support mechanisms, and some is left on the already cut concrete surface. When a hand or power trowel is then used to finish off the concrete surface these implements do not cut the concrete surface and tend to ride the areas where the concrete residue has been deposited, which results in these areas being slightly elevated.

There is also the cost in time, labour and productivity in cleaning the excess concrete spillage from the casting bed.

DISCLOSURE OF THE INVENTION

The present invention is a composite concrete sideform system comprising a substantially rigid longitudinally extending wall. The wall has a first face to define the edge profile of a concrete panel poured onto a casting bed bounded by the wall. A second face opposite the first face has formations to enable the wall to be secured to the casting bed. The wall comprises a longitudinally extending frame having formations along at least one of its edges to removably receive a removable longitudinal insert to provide a shape along an edge of the concrete panel.

The removable inserts provide the system with the ability to simply, easily and cost effectively change the edge profiles of concrete poured against the sideform. Architects can use the invention to specify standard or non standard edge profiles and achieve a much more diverse range of aesthetic finishes to the concrete edges without the cost being prohibitive.

The frame may have formations along its lower edge to removably receive a removable base edge insert of resilient material to seal between the first face and the bed. This insert may also provide a shape along the lower edge of the concrete panel. The frame may have formations along its upper edge to removably receive a capping insert to provide a shape along the upper edge of the concrete panel. Where there are formations along both the upper and lower edges of the frame they may be identical, and in this case the frame may be symmetrical along its horizontal axis.

The frame may be fabricated from metal, such as extruded aluminum, or plastics material. The base edge inserts may be made from rubber or plastics. The capping inserts may be made from alloy or polymer.

The inserts may be formed to impart any desired shape to the edge of the concrete panel. The inserts may extend to cover part or all of the first face of the frame. The inserts may also add height to the wall. Alternatively, extension pieces may be used to add height to the wall by fitting to the frame formations and themselves having formations to releasably receive an insert. In this way the invention may enjoy the ability to simply, easily and cost effectively change the thickness of the concrete panel being cast without having to replace the sideform.

An extension along the rear of the capping inserts may be used to protect the securing formations from concrete spillage.

A formation, such as a notch or step may be provided in the upper surface of the capping inserts directly above the first face, to assist in setting out the sideforms correctly on the casting bed.

An upper edge may be provided along the top of the capping inserts to assist in forming a clean top edge to the poured concrete.

A slurry catching channel may be incorporated into the capping inserts to catch concrete spillage and slurry resultant from pouring, levelling (screeding) and finishing the concrete panel. The channel may also help stop excess concrete from spilling onto the casting bed and wall fixing mechanisms.

A scrapping edge may also be incorporated into the capping inserts. This edge assists in removing excess concrete from the concrete screed trowel that is used to level the concrete, both as it moves across the sideform from the concrete surface, and once again as the trowel travels across the sideforms back onto the concrete surface. This is important in that it reduces the problem of excess concrete being left on the concrete surface. It also keeps the screed trowel a lot cleaner thus allowing for a much better surface finish eliminating drag marls left by excess concrete on the screed.

The scraping edge also cleans the trowels used for finishing the concrete.

End pieces may be provided to connect to the ends of the frame and seal them to the side of adjacent frames to make corners in the sideform.

Both external and internal corner pieces may also be provided to connect the frames end to end and make corners in the sideform.

BRIEF DESCRIPTION OF THE DRAWINGS

A number of examples of the invention will now be described with reference to the accompanying drawings, in which:

FIG. 1(*b*) is an end elevation; FIG. 1(*c*) is an exploded view of the sideform; and FIG. 1(*d*) is an end elevation showing the base of the sideform in contact with a casting bed.

FIG. 2(*b*) is an end elevation; and FIG. 2(*c*) is an exploded view of the sideform.

FIG. 3(*b*) is an end elevation of a sideform frame extension; and FIG. 3(*c*) is the capping of FIG. 3(*a*) mounted on the frame extension of FIG. 3(*b*);

FIG. 4(*b*) is an end elevation of the sideform with a second capping and a second base edge.

FIG. 7(*b*) is an end elevation of the sideform with the first capping and a second base edge; and FIG. 7(*c*) is an end elevation of the sideform with a second capping and a third base edge.

FIG. 13(*b*) is an end elevation of another sideform capping profile; and FIG. 13(*c*) is an end elevation of another sideform capping profile.

FIG. 14(*b*) is an end elevation of another sideform capping profile.

FIG. 16(*b*) is an elevation and FIG. 16(*c*) is another pictorial view of the sideform joiner.

FIG. 17(*b*) is a side elevation of the sideform joined to the sideform joiner and an end elevation of a separate sideform; and FIG. 17(*c*) shows the sideforms joined using the sideform joiner.

BEST MODES OF THE INVENTION

Figure 1C:
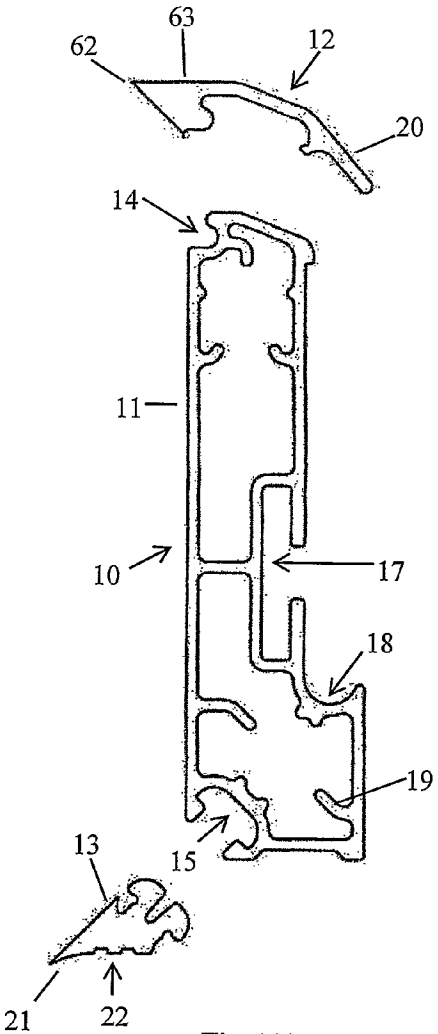
FIG. 1(*a*) is a pictorial view of a first sideform.
Figure 1B:
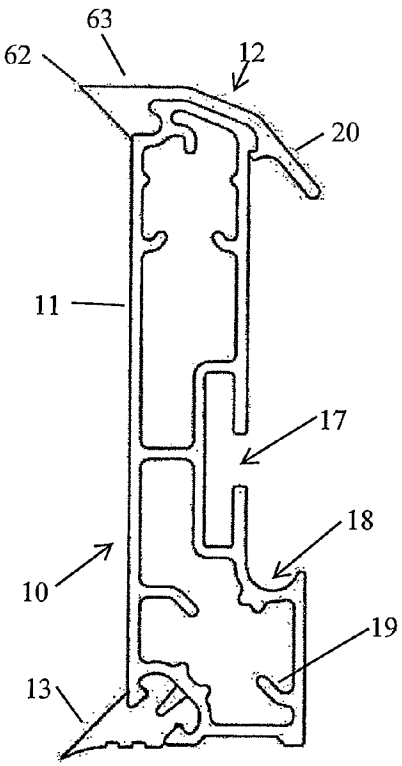
Figure 1A:
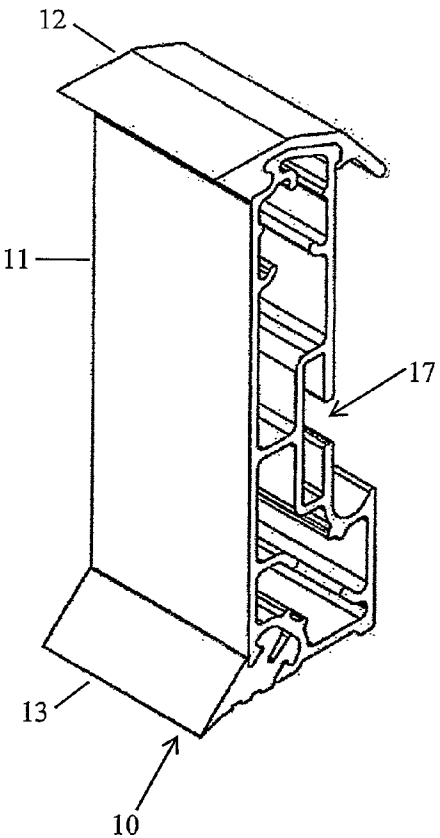
Figure 1D:
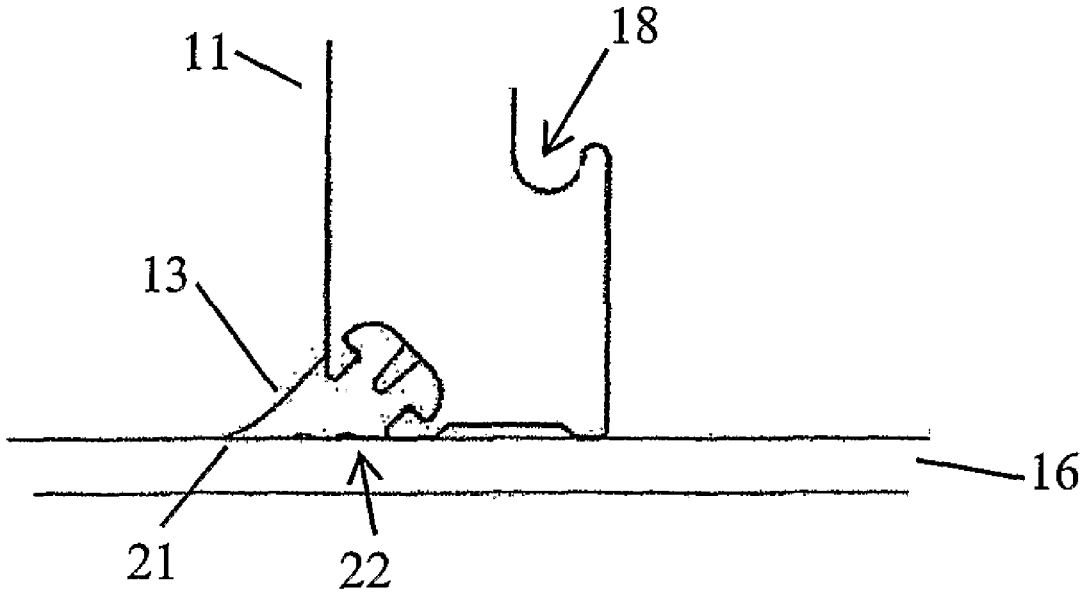

Referring first to FIG. 1, sideform 10 is a mono-sided composite sideform for factory casting; it cannot be used upside down. The sideform is comprised of an extruded aluminum (or plastics) frame 11, a capping insert 12 made from extruded from alloy or polymer, and a base edge insert 13 made from plastics or rubber. Formations 14 and 15 in the top and bottom of frame 11 cooperate with formations on the inserts 12 and 13 to releasably connect them together. When the inserts are attached to the frame they create a shaped edge to the poured concrete panel; the edge has a vertical section where it meets the frame and corners chamfered at 45° along its upper and lower edges.

A 'T'-shaped slot 17 in the back of the sideform is provided for securing it to the bed. This formations allow a bolt or uni-bolt to be inserted, or alternatively a plate with threaded lugs. The sideform is then secured to a factory casting bed using magnets, or to a panel cast underneath with steel angles. A ball lock rail 18 in the back of the sideform is also provided for securing it to the bed using a clip on magnetic fastener.

Formations inside frame 11, such as 19 are provided to cooperate with sleeves to join the frames together. An extension 20 from the back of the capping insert 12 shields the 'T'-shaped slot 17, the ball lock rail 18 and any securing equipment from excess falling concrete. When the sideform is placed on a casting bed 16, the base edge insert 13 deforms to conform to the shape of the bed, ensuring there are no leaks. In particular the lip 21 and ribs 22 provide the seal.

Figure 2C:
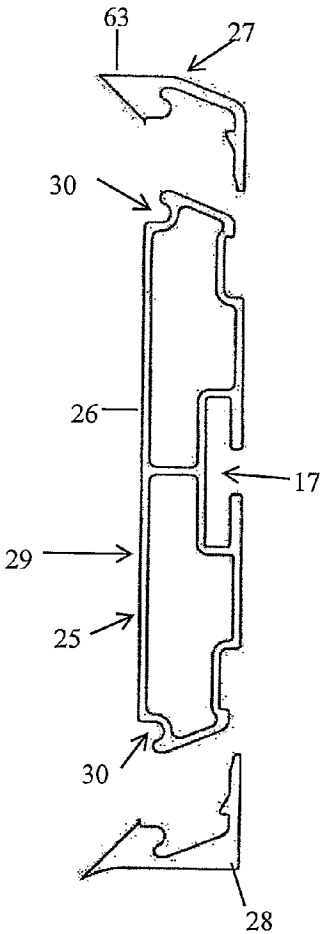
FIG. 2(*a*) is a pictorial view of a second sideform.
Figure 2B:
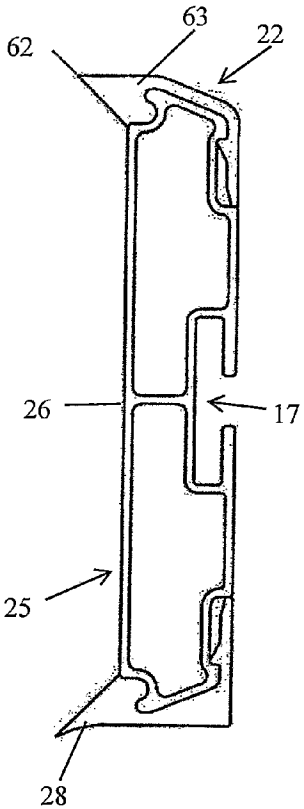
Figure 2A:
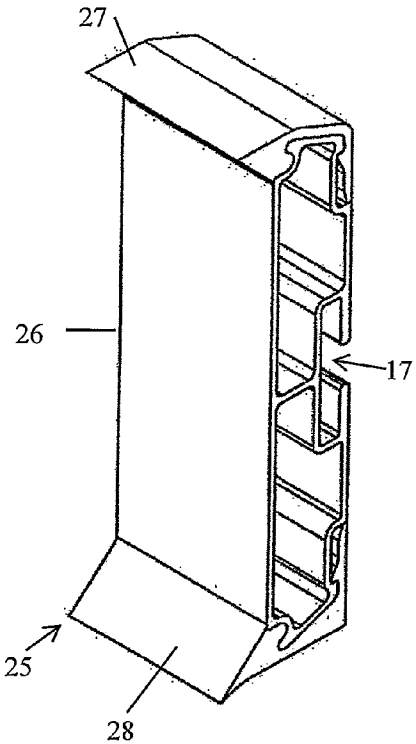

In FIG. 2 sideform 25 is a double sided composite sideform for site casting. Again there is an extruded aluminium frame 26, a capping insert 27 and a base edge insert 28. There is also a 'T'-shaped slot 17 in the back. However, the frame 26 is symmetrical about the horizontal mid-line 29 and the formations 30 at the top and bottom are identical, so that the frame 26 can be turned upside down and the capping insert 27 and base edge insert 28 can be swapped over to allow easy raising of the sideform from a completed panel to be ready to pour another panel on top of it.

Frames 11 and 26 with their inserts are used to manufacture a concrete panel 150 mm thick. By changing the inserts an almost limitless range of different edge profiles can be created in the concrete. By selecting different capping and base edge inserts the upper and lower edge profiles in the concrete may be different.

The capping inserts are fitted to the frame by simply rolling them onto the top of the frame so that they snap lock into position. They are removed by pulling them away from the rear by hand and rolling them over the top of the frame.

The base edge inserts are fixed to the frame by pushing them into place, and they are removed by simply pulling them free.

Figure 3C:
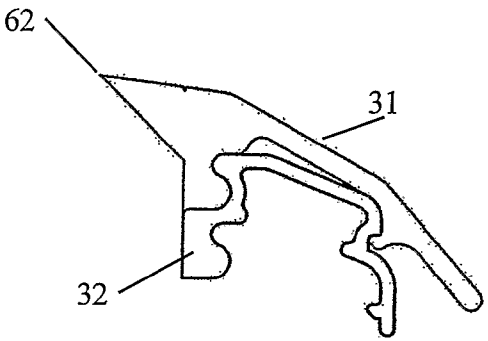
FIG. 3(*a*) is an end elevation of sideform capping insert.
Figure 3B:
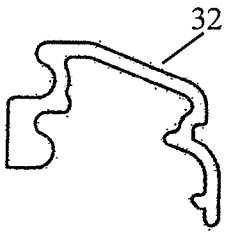
Figure 3A:
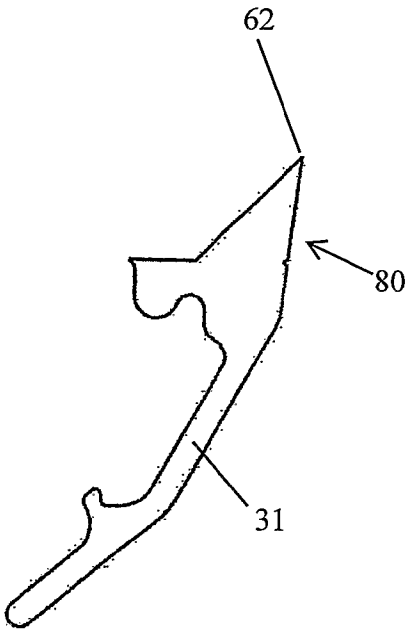

FIG. 3(*a*) shows an extended capping insert 31 that is, say, 5 mm higher than the standard capping and its use increases the thickness of the concrete panel being cast. Another way of increasing the thickness is to use a frame extension piece 32, as shown in FIG. 3(*b*), and this raises the height of the frame by, say 10 mm. When both are used, as shown in FIG. 3(*c*) the combined increase in height is achieved. Of course, both the extended capping insert and frame extension piece can be made in a range of sizes.

Figure 5:
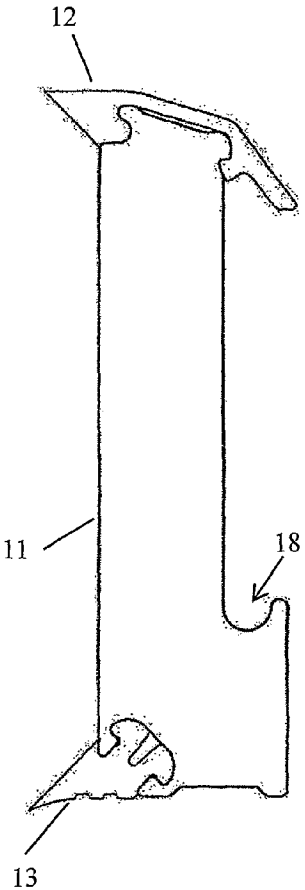
FIG. 5 is an end elevation of another sideform with a first capping and first base edge.
Figure 4B:
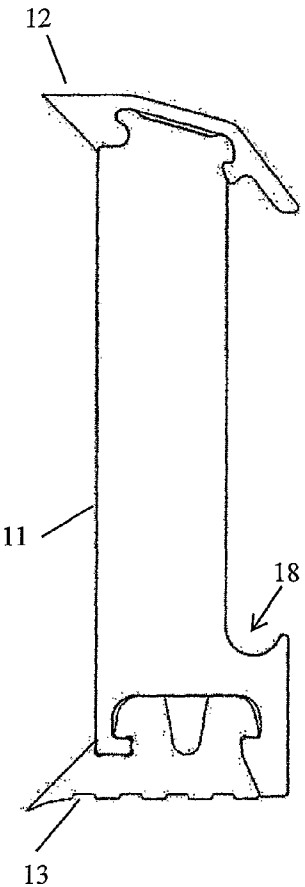
FIG. 4(*a*) is an end elevation of another sideform with a first capping and a first base edge.
Figure 4A:
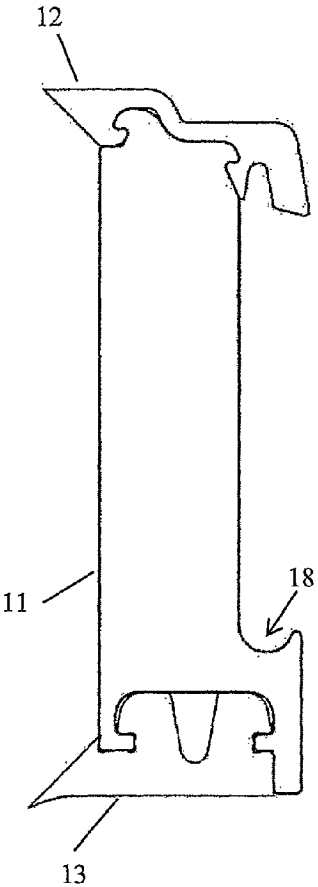
Figure 7C:
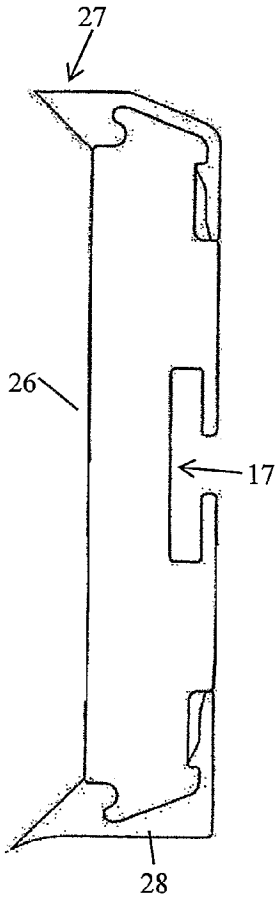
FIG. 7(*a*) is an end elevation of another aluminium sideform with a first capping and a first base edge.
Figure 7B:
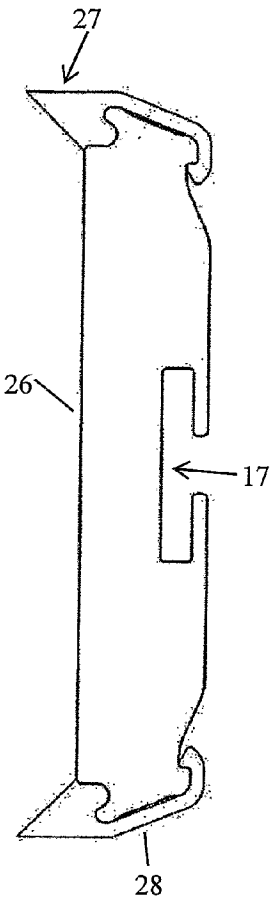
Figure 7A:
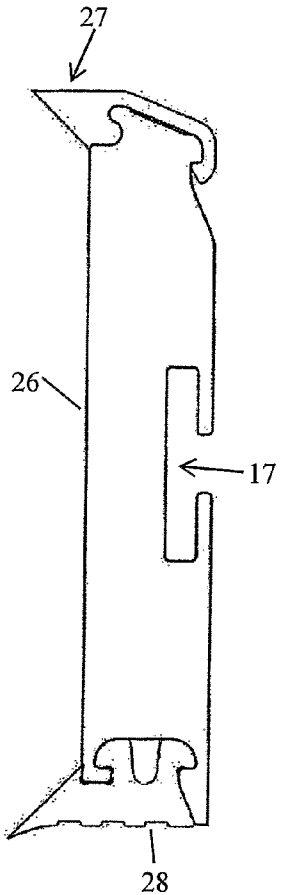
Figure 6:
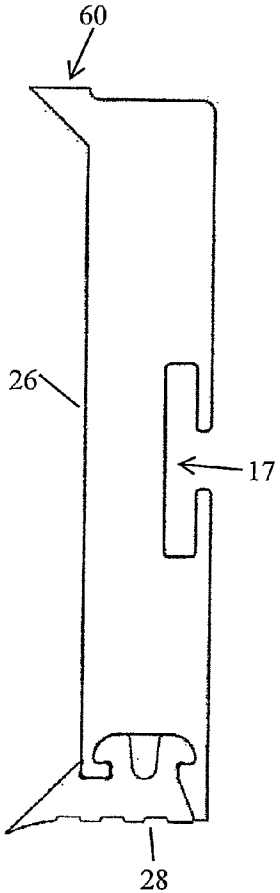
FIG. 6 is an end elevation of a heavy gauge, extruded aluminium non reversible sideform, primarily for use in factory casting.
Figure 9:
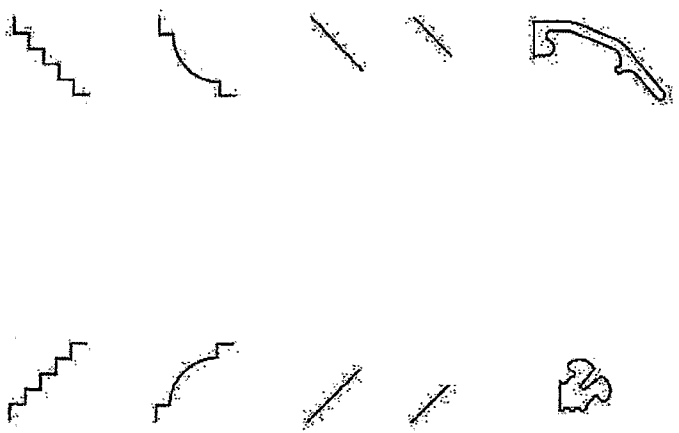
FIG. 9 is a series of sideform capping and base edges for non-reversible sideforms.
Figure 8:
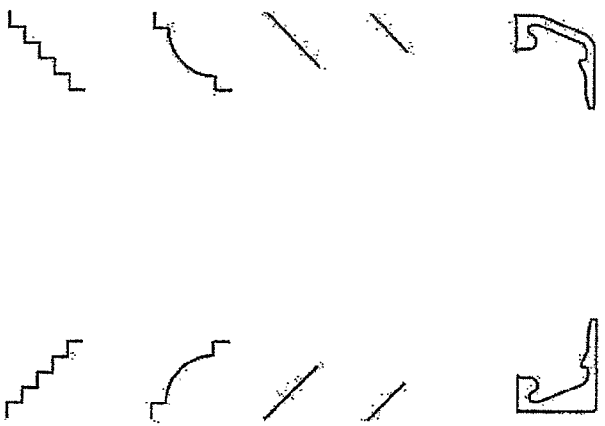
FIG. 8 is a series of shapes available for sideform capping and bases for dual sided sideforms.
Figure 10:
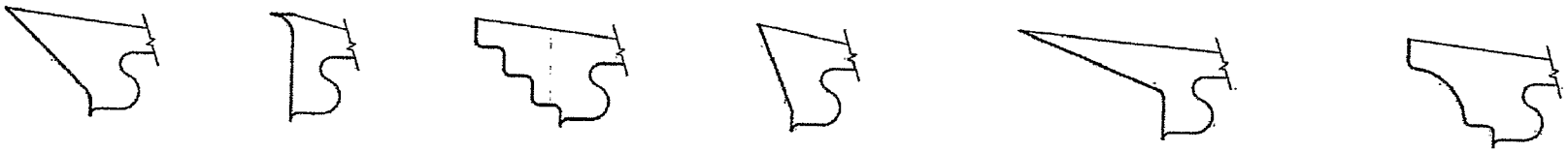
FIG. 10 is a series of different sideform capping shapes.
Figure 11:
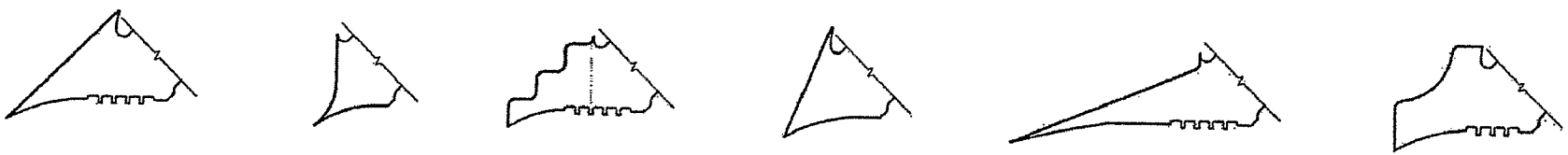
FIG. 11 is a series of different base edge shapes.
Figure 12C:
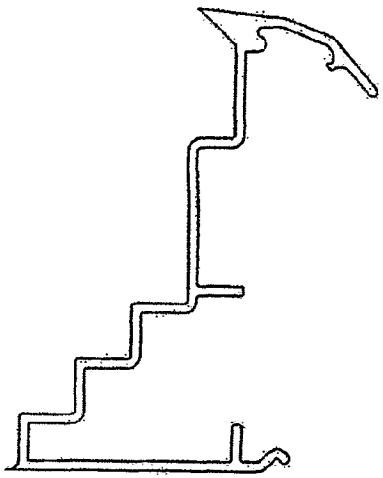
FIGS. 12(*a*), (*b*), (*c*), (*d*), (*e*), (*f*) and (*g*) are window sill profiles.
Figure 12B:
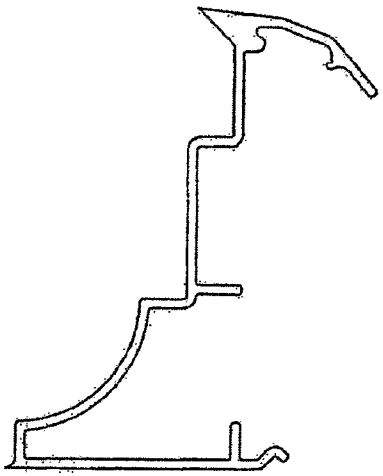
Figure 12A:
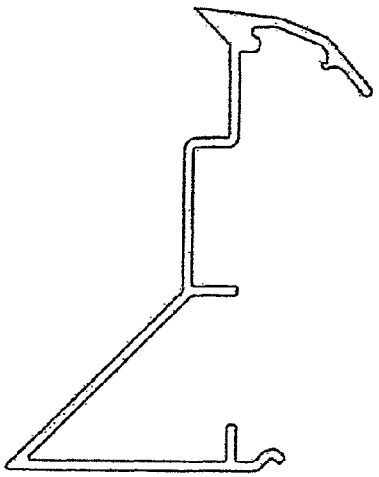
Figure 12G:
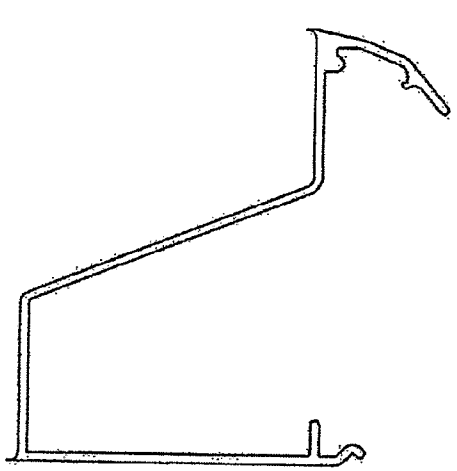
Figure 12F:
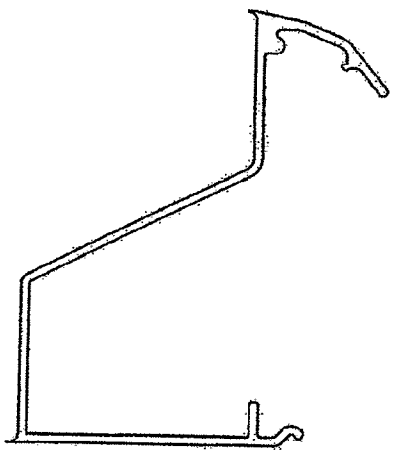
Figure 12E:
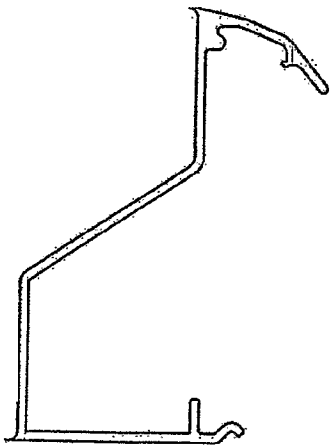
Figure 12D:
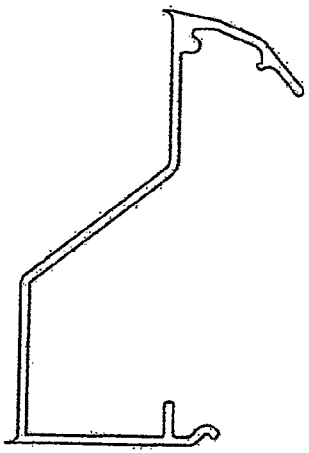

FIGS. 4 and 5 show a number of variations in the mono-sided composite sideforms. FIG. 6 shows another variation where there is no capping insert, but only a base edge insert. FIG. 7 show a number of variations in double sided composite sideforms. FIGS. 8 and 9 show a range of upper and lower profile shapes that could be formed in concrete panels formed using different inserts. FIG. 10 shows a range of different capping insert shapes, and FIG. 11 shows a range of different base edge insert shapes. FIG. 12 show a range of different base edge inserts that can be used to manufacture window ledges of different shapes.

Referring again to FIGS. 1 and 2, the point 62 of the capping insert meets the top edge of the poured concrete at its finished level. When the concrete is poured there is excess concrete that is removed by a screed trowel that comes down to the correct level and moves back and forth. The screed trowel meets the point 62 and passes over the horizontal area 63. This prevents the screed trowel and other finishing plant and equipment from riding up at the edges of the concrete panel.

Figure 13A:
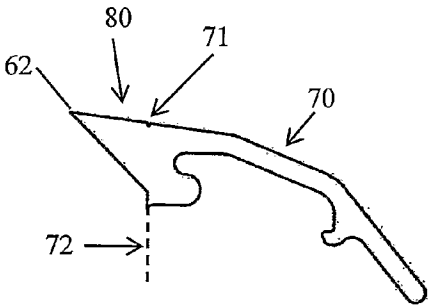
FIG. 13(*a*) is an end elevation of another sideform capping profile.
Figure 13B:
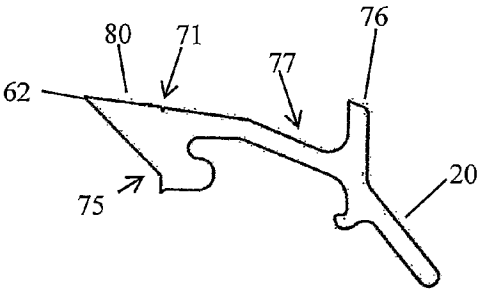
Figure 13C:
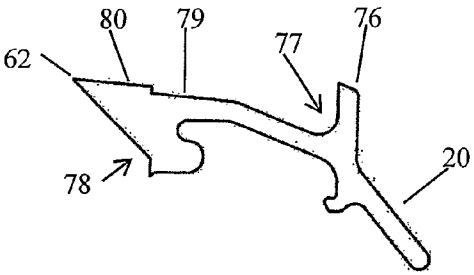

FIG. 13(*a*) shows a capping insert 70 which has a 'V' notch 71 on the top of the profile directly above the front wall 72 of the frame to which it is clipped. This facilitates measurements for setting the frames the required distance apart.

FIG. 13(*b*) shows a variation 75 of the capping insert in which a screed trowel scraping edge 76 is provided. When the screed trowel moves of the wet concrete and over the capping insert excess concrete stuck to the bottom of the trowel is scraped off by the edge 76 and collected in the collection area 77.

FIG. 13 (*c*) shows a variation 78 of the capping insert in which the 'V' notch is replaced by a step 79.

In FIG. 13, like FIG. 3 the upper surface 80 of the capping inserts slope down away from the edge of the concrete so as to only give "point contact" on the concrete screed and finishing equipment.

Figure 14A:
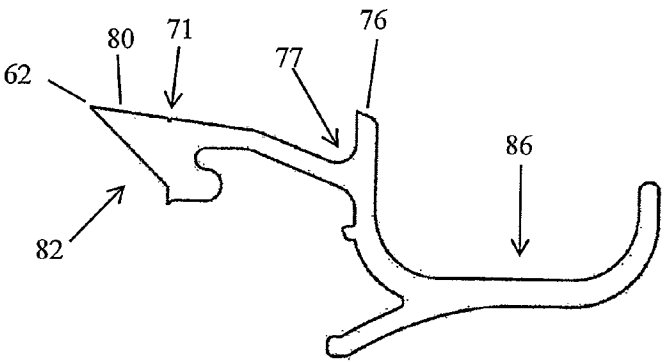
FIG. 14(*a*) is an end elevation of another sideform capping profile.
Figure 14B:
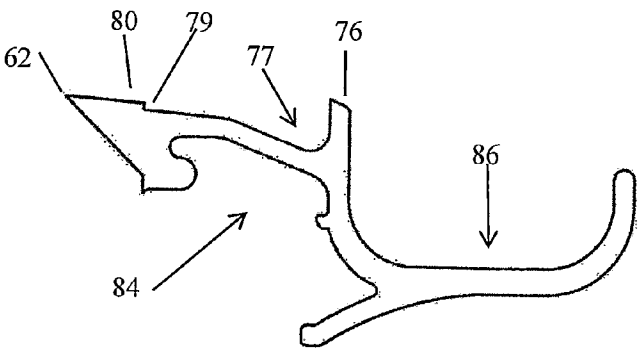
Figure 15A:
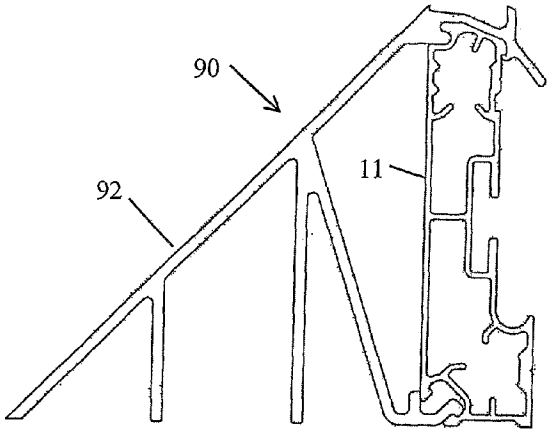
FIGS. 15(*a*), (*b*), (*c*) and (*d*) are end elevations of capping inserts showing different angles of elevation that extend across the entire face of the frame.
Figure 15B:
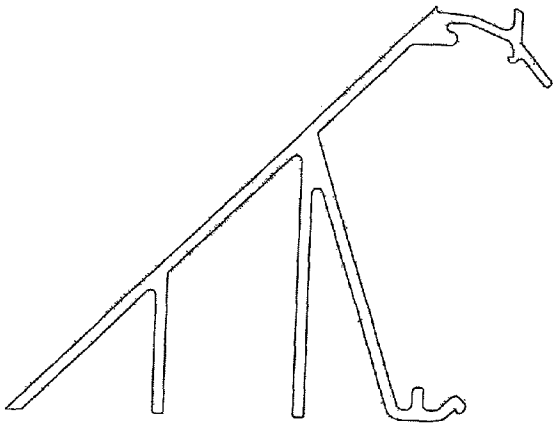
Figure 15C:
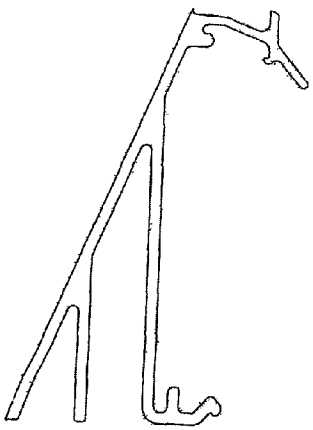
Figure 15D:
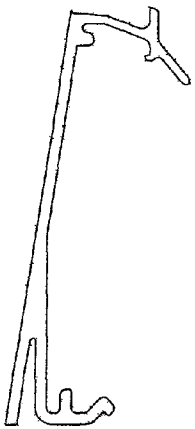

In FIGS. 14(*a*) and (*b*) there are two additional variations 82 and 84 equipped with a further slurry catching channel 86

FIG. 15(*a*) show a sideform 90 having a capping insert 92 that extends down the entire face of the frame 11 at 45°. FIGS. 15(*b*), (*c*) and (*d*) show capping inserts that provide faces at a range of other angles.

Figure 16C:
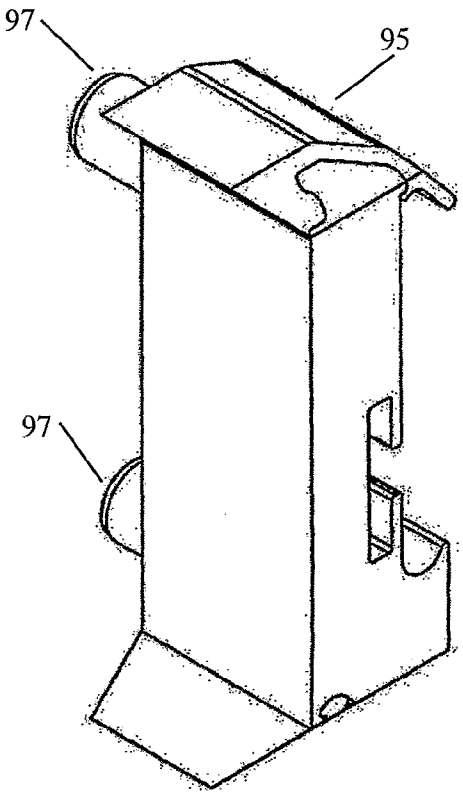
FIG. 16(*a*) is a pictorial view of a sideform joiner.
Figure 16B:
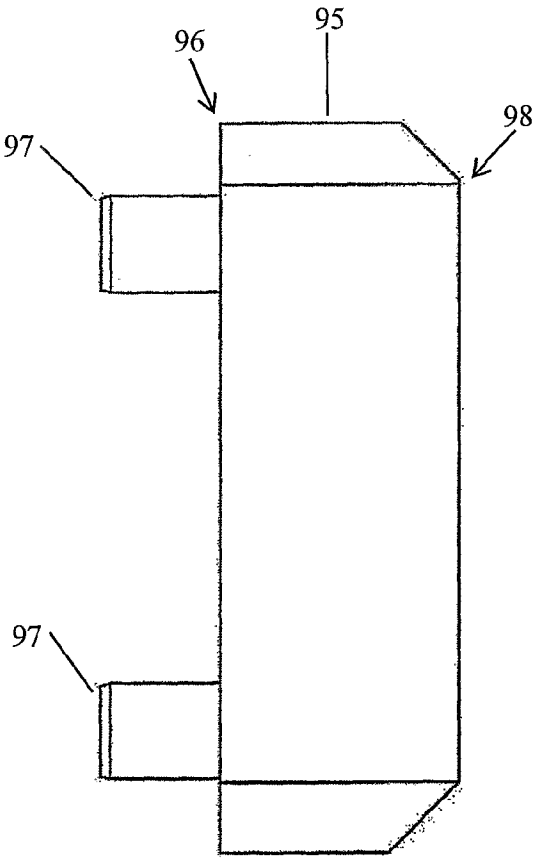
Figure 16A:
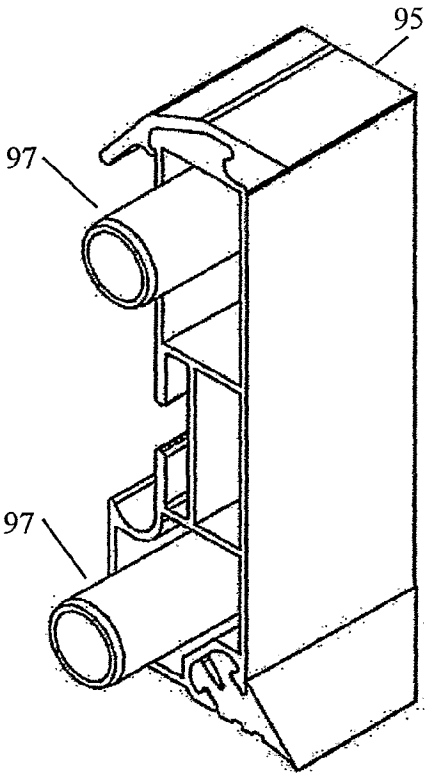
Figure 17C:
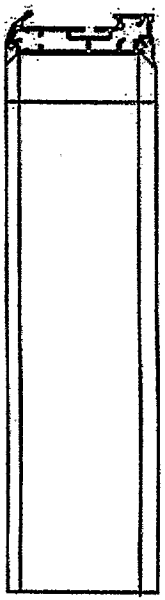
FIG. 17(*a*) is an exploded view of a side elevation of a sideform, a sideform joiner and an end elevation of a sideform.
Figure 17B:
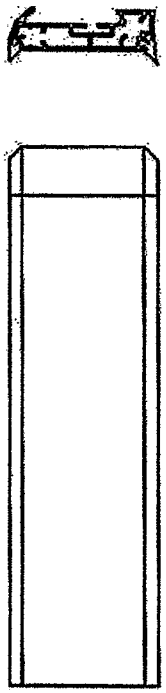
Figure 17A:
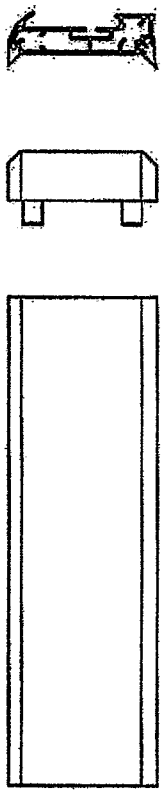

FIG. 16 show a sideform end cap 95 used to joint two sideforms together end to end. A first side 96 of the end cap 95 has sockets to receive a peg 97 which push into the end of the frame and engage with its internal formations 19 (see FIG. 1(*b*) or (*c*) and FIGS. 17 (*a*) and (*b*)). The other side 98 is shaped to fit snugly into the side of a composite sideform made up of a frame and inserts (see FIGS. 17(*b*) and (*c*)).

Figure 19:
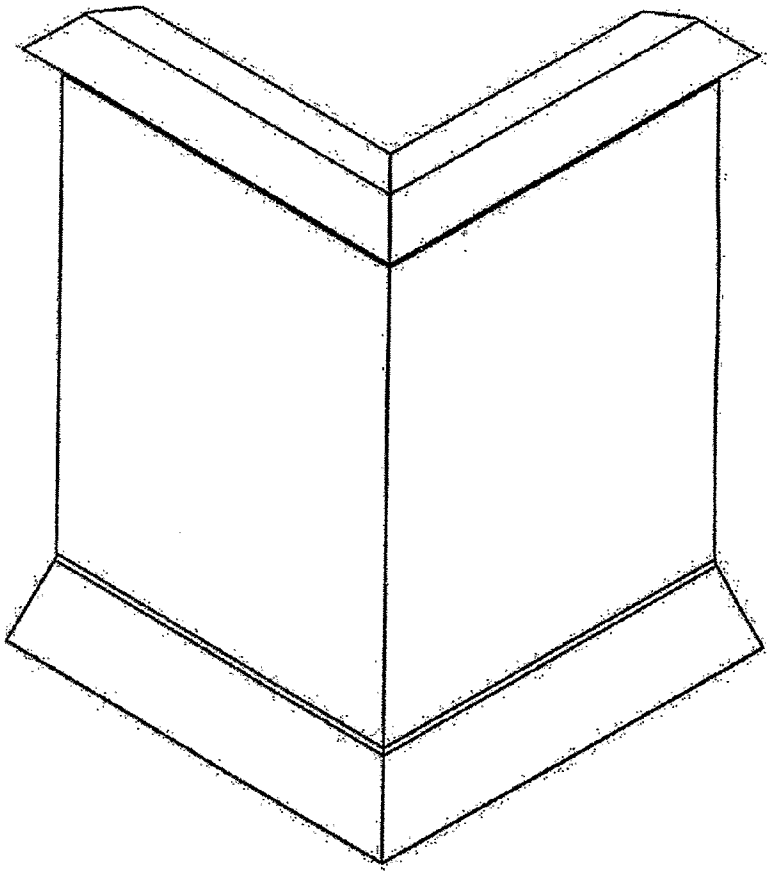
FIG. 19 is a pictorial view of an internal corner.
Figure 18:
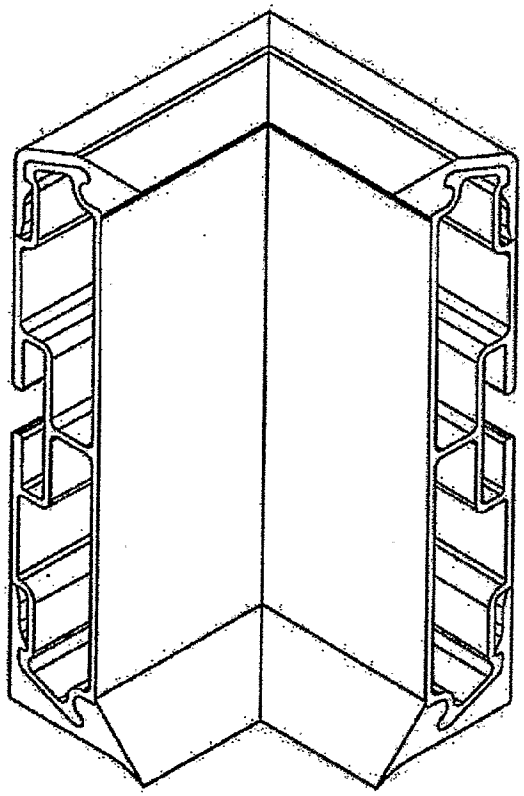
FIG. 18 is a pictorial view of an external corner.
Figure 20:
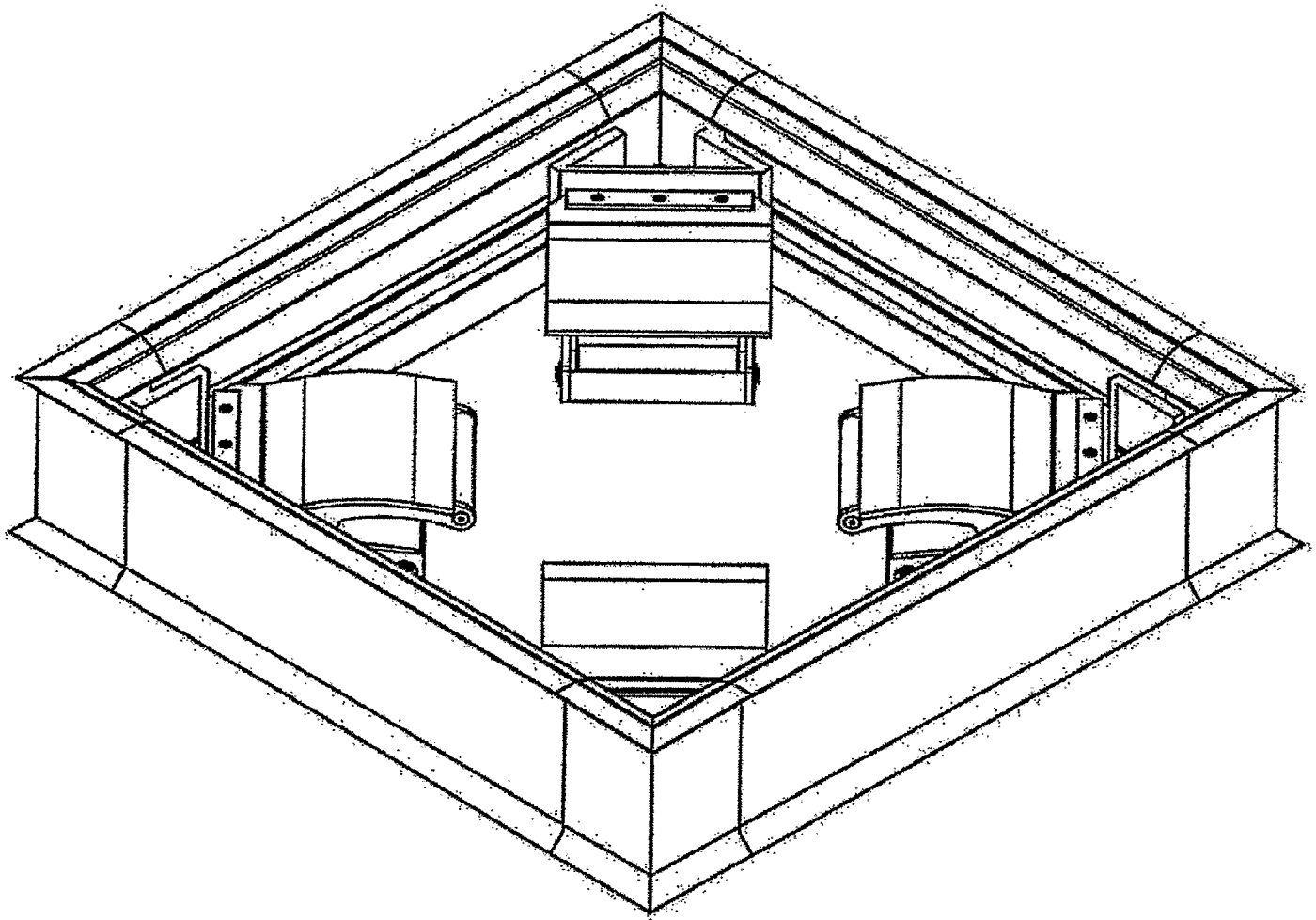
FIG. 20 is a pictorial view of a series of sideforms connected together to form an exterior mould.

FIG. 18 is a moulded external corner unit that is connected to the ends of two frames to create a 90° corner. The corner unit fits to the frames using pegs 97. FIG. 19 shows a moulded internal corner unit. FIG. 20 shows four composite sideforms connected together by external corner units to create an island within a poured concrete panel, perhaps for use as a window.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A composite concrete sideform system comprising:

a substantially rigid longitudinally extending wall, the wall having a first front face to define an end profile of a concrete panel to be poured onto a casting bed bounded by the wall and a second rear face opposite the first front face having at least one of a slot and a rail located in spaced relationship relative to a lower edge of the wall, and adapted for positive engagement by one of a bolt, uni-bolt, plate with threaded lugs and magnetic fastener to secure the wall to the casting bed, a longitudinally extending insert formed of a resilient flexible material comprising:

an edge profile to impart a shape to an edge of a concrete panel to be cast using the sideform system; and an attaching member, wherein the wall comprises a longitudinally extending frame having at least one receiving formation along at least one of its upper or lower edges arranged to removably receive the attaching element of the longitudinally extending insert to impart a shape to a correspondingly upper or lower edge of the concrete panel to be cast, and wherein the receiving formation is arranged to retain the insert in a position such that the insert is interchangeable with other inserts independent of a shape imparted to the other of the upper or lower edges of the concrete panel to be cast.

2. A composite concrete sideform system according to claim 1, wherein the at least one receiving formation of the frame comprises a first receiving formation along its lower edge to removably receive a removable base edge insert of a resilient material substantially to seal between the first front face and the bed, the base edge insert imparting its shape to a lower edge of the concrete panel to be cast.

3. A composite concrete sideform system according to claim 1, wherein the at least one receiving formation of the frame comprises a second receiving formation along its upper edge to removably receive a capping insert, the capping insert imparting its shape to an upper edge of the concrete panel to be cast.

4. A composite concrete sideform system according to claim 1, wherein the at least one receiving formation of the frame comprises a first receiving formation along its lower edge and a second receiving formation along its upper edge, and the first receiving formation and the second receiving formations are identical and the frame is symmetrical about a horizontal mid-line.

5. A composite concrete sideform system according to claim 1, wherein the frame is fabricated from one of a metal and a plastics material.

6. A composite concrete sideform system according to claim 2, wherein the base edge insert is made from one of a rubber and a plastics material.

7. A composite concrete sideform system according to claim 3, wherein the capping insert is made from one of an alloy and a polymer.

8. A composite concrete sideform system according to claim 1, wherein the insert extends to cover part or all of the first front face of the wall.

9. A composite concrete sideform system according to claim 1, wherein the insert is dimensioned to provides additional height to the wall.

10. A composite concrete sideform system according to claim 9, wherein the insert is an assembly comprising an extension piece which provides additional height to the wall by fitting to the receiving formation of the frame and a capping insert removably attachable to the extension piece.

11. A composite concrete sideform system according to claim 3, wherein the capping insert defines a tail extension protects the at least one of the slot and the rail of the second rear face from concrete spillage.

12. A composite concrete sideform system according to claim 3, wherein a positioning formation is provided in an upper surface of the capping insert, the positioning formation being aligned, in use, with the first front face, to assist in positioning the wall on the casting bed.

13. A composite concrete sideform system according to claim 3, wherein an upper edge profile is provided along a top of the capping inserts.

14. A composite concrete sideform system according to claim 3, wherein a slurry catching channel is defined in the capping inserts to catch concrete spillage and slurry resultant from pouring, levelling and finishing the concrete panel.

15. A composite concrete sideform system according to claim 3, wherein a scrapping edge is incorporated into the capping insert to assist in removing excess concrete from a concrete screed trowel used to level the concrete.

16. A composite concrete sideform system according to claim 1, further comprising end pieces connected to ends of a plurality of frames to form corners in the sideform.

17. A composite sideform system according to claim 16, further comprising end pieces which form both external and internal corners of the concrete panel to be cast.

* * * * *